United States Patent [19]

Müller

[11] 4,199,831

[45] Apr. 29, 1980

[54] MATTRESS SECURING APPARATUS

[76] Inventor: Sylvio Müller, 21 Brookdale Rd., Glen Cove, N.Y. 11542

[21] Appl. No.: 974,194

[22] Filed: Dec. 28, 1978

Related U.S. Application Data

[63] Continuation-in-part of Ser. No. 830,464, Sep. 6, 1977, abandoned.

[51] Int. Cl.[2] ..... A47C 22/00

[52] U.S. Cl. ..... 5/411; 5/498

[58] Field of Search ..... 5/203, 402, 411, 498

[56] References Cited

U.S. PATENT DOCUMENTS

| | | | |
|---|---|---|---|
| 2,666,931 | 1/1954 | Clerc | 5/203 |
| 3,350,726 | 11/1967 | Gardner | 5/411 |
| 4,017,919 | 4/1977 | Hemmeter | 5/411 |

FOREIGN PATENT DOCUMENTS

| | | | |
|---|---|---|---|
| 202300 | 2/1959 | Austria | 5/411 |
| 14458 | of 1905 | United Kingdom | 5/66 |

*Primary Examiner*—Casmir A. Nunberg
*Attorney, Agent, or Firm*—Robert D. Farkas

[57] ABSTRACT

A mattress securing apparatus utilizes four right angle corner guards disposed at the corners of a mattress resting on a device having a mattress supporting surface therein such as a box spring to prevent lateral displacement of the mattress relative to the supporting surface. A plate, affixed to each corner guard and perpendicular to the right angle leg portions thereof is located between the supporting surface and the lowermost surface of the mattress. A harness, including an elastic member is located in criss cross fashion, connecting the four corner guards together, urging the corner guards in touching engagement with the corners of the mattress and mattress supporting device. A pair of cords flexibly connect adjacent pairs of corner guards together preventing the corner guards from accidental dislodgement when one corner of the mattress is lifted. A securing plate is utilized to maintain the area of the harness together where the harness elements cross or engage each other near the mid area of the mattress.

8 Claims, 2 Drawing Figures

MATTRESS SECURING APPARATUS

This application is a continuation-in-part of prior U.S. application Ser. No. 830,464 filed Sept. 6, 1977 abandoned.

BACKGROUND OF THE INVENTION

1. The Field of the Invention

This invention relates to bed apparatus and more particularly to that class of devices utilized to restrain the displacement of a mattress from a resting surface therebelow.

2. Description of the Prior Art

The prior art abounds with devices designed to retain a mattress in a fixed position relative to a supporting surface. U.S. Pat. No. 3,520,030 issued on July 14, 1970 to S. B. Hawkins discloses a mattress stay comprising a pair of flexible bands attached adjacent to the corners of a supporting surface and a supermost mattress supported thereby. The bands are located in criss-cross fashion, one end of each being secured to a box spring type supporting surface and the other end being secured to the mattress. This apparatus prevents the total removal of the mattress from the supporting surface without disconnecting the ends of the straps or bands connected to the mattress. Furthermore the apparatus restricts the uppermost displacement of the mattress corner when the apparatus is connected to the mattress and the supporting surface.

U.S. Pat. No. 3,350,726 issued on Nov. 7, 1967 to O. N. Gardner, teaches a mattress retainer utilizing four corner guards in a harness assembly flexibly interconnecting them. The harness assembly, when the apparatus is in use, is located on the uppermost resting surface of a box spring or similar device as are the bars to which the ends of the harness are fastened. The bars are fastened to the corner guards at approximately a mid portion of the length thereof. In use, the guards having a substantially right angle cross-section are disposed in vertical fashion, having a portion adjacent the lowermost marginal edge secured to the lowermost portion of the corners of the supporting surface. Thus, when the harness assembly is tightened, the corner guards serve as third class levers having the uppermost regions of the guards restricting the corners of the mattress from lateral displacement. This device depends upon an adjustment of the legs of the harness to determine the amount if inward force directed at the corners of the mattress. Furthermore, the corner guards, by being secured to the box spring complicate installation and removal thereof.

SUMMARY OF THE INVENTION

A primary object of the present invention is to provide an inexpensive mattress securing device which facilitates convenient bed sheet replacement.

Another object of the present invention is to provide an apparatus which may be conveniently installed to any sized mattress and equivalently sized supporting structure therebelow.

Still another object of the present invention is to provide an apparatus which remains in place when a corner of the mattress is lifted.

Yet another object of the present invention is to provide an apparatus which utilizes the same components regardless of the size of the mattress.

Heretofore, mattress securing devices, primarily employed schemes in which portions of the device were permanently or pseudo-permanently attached to the mattress or the mattress resting surface. The present invention eliminates the need to attach portions of the apparatus to either structure by providing four corner guards, each of which is maintained at the corners of the mattress by a harness assembly and a cord device. The harness assembly is adjustable in length and width so that the corner guards may be installed on any size mattress having four corners. The harness assembly, comprising a plurality of straps is adapted to rest on the uppermost mattress supporting surface of a mattress supporting structure and maintained in contact with the lowermost surface of the mattress. The flexible cord flexibly connects adjacent pairs of corner guards together so as to prevent accidental dislodgement or dislocation of a corner guard when the corner of the mattress adjacent thereto is lifted upwardly. A plate is utilized to secured together portions of the harness which criss-cross in the area of the center of the mattress, thereby providing further security to the accidental dislodgement of the corner guards.

These objects, as well as other objects of the present invention, will become more readily apparent after reading the following description of the accompanying drawings.

DESCRIPTION OF THE PREFERRED EMBODIMENT

Figure 1:
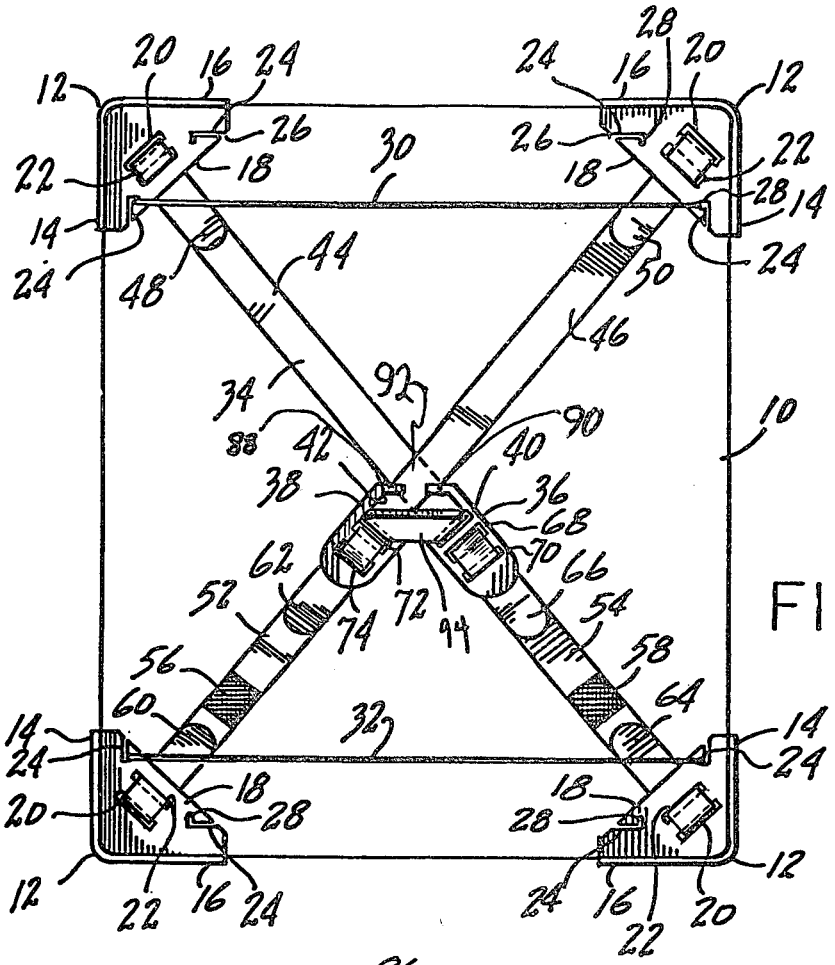
FIG. 1 is a plan view of the present invention shown installed on a supporting surface.

The structure and method of fabrication of the present invention is applicable to four corner guards each of which is preferably fabricated in unitary fashion from a plastic material such as polypropylene. Each corner guard has a right angle cross-section having two leg portions located at right angles to each other. Each corner guard has an uppermost end and a lowermost end, when the corner guard is installed residing at the corner of a mattress and adjacent to the corner of a mattress supporting device, such as a box spring assembly. The ends of each of the four corner guards, substantially correspond to the ends of the two leg portions. In use, the corner guards are not permanently secured to either the mattress or the mattress supporting device, but are installed thereon in a clamping form of engagement.

An additional plate member is secured to the right angle cross-section member such that a lateral surface of the additional plate is at right angles to each of the legs and disposed substantially midway along the length of the right angle member. The additional plate is provided with a pair of slots located in spaced apart parallel relationship, each at an angle skew to both legs. A pair of notches are also formed in the additional plate each extending for a portion of their length parallel to an adjacent leg. The remaining portion of the length of the notch extends transverse from the adjacent leg member towards the free marginal edge of the additional plate.

The harness assembly, in the preferred embodiment comprises three flexible bands, preferably fabricated from a woven fabric material, similar to the variety utilized in automotive seat belt straps. One or more band elements may have a portion of their length comprising a spring member, preferably fabricated from an elastic material such as utilized in shock cords. A plate member is utilized in the harness assembly to secure one end of the second and third band members thereto. The plate member is provided with two pairs of slots, each pair of which is angularly disposed relative to one or another having the slot elements therein disposed in parallel spaced apart relationship. An opening is provided in the plate member. Adjacent the opening is another pair of slots wherein each slot member is disposed skew to one another and is located adjacent the opening. The first band member has a median portion of the length thereof passing through the opening and successively through each of the additional pairs of slots so as to align the longitudinal axes adjacent the free ends of the band at an acute angle. The free ends of the first band member pass successively through the outermost slot, located adjacent the corner of the "L" shaped section and then through the innermost slot of an adjacent pair of corner guards. Thus, the free ends of the first band member may be pulled inwardly towards the plate member causing the corner guard to which it is affixed to be adjustably located relative to the installed position of the plate member on the supporting surface. In similar fashion, the free ends of the second and third band members may be adjusted so as to provide a variable length of these band members by passing through the pairs of slots in the other pair of corner guards and the pairs of slots located in the plate member that have slots parallel to each other.

The pairs of slots, locating each of the additional plates, secured to each of the foregone corner guards, may be utilized for purposes of adjusting the length of the harness assembly bands, extending over the mattress supporting surface and below the mattress, by judicious looping of the band elements through such pairs of parallel, spaced apart, pairs of slots. In the preferred embodiment, the portion of the flexible band, extending from substantially the center of the mattress, is permitted to extend below the lowermost surface of the additional plate. Thence, the band passes into the outermost slot, closest to the corner of the "L" shaped section, and thence through the innermost slot, downwardly, below the surface of the additional plate. In this way, the flexible band only has a small portion of the length thereof exposed to view, when viewing the uppermost surface of the additional plate, such portion extending intermediate the distance separating the pair of slots. In all other areas, the remaining length of such flexible bands, resides either directly below the additional plate or, continues to reside on the uppermost surface of the mattress supporting device. The opening provided in the plate member having two pairs of slots therein, in the preferred embodiment, is utilized so as to secure the median portion of the first band member by providing such plate with an opening that is notch shaped. Such notch shaped opening terminates or is bounded by a pair of legs, such legs being useful in causing those portions of the first flexible band member, extending outwardly from such plate, to be clamped to the uppermost surface of the mattress supporting device. This is accomplished by applying a concentrated pressure, caused by such legs or ends of the plate defining the openings, to be exerted on the median portions of the first band member, in the vicinity where such band member crosses one another. Here, in such vicinity, the band member is twice as thick, as compared to other regions thereof. Here, in such regions, the free ends of the legs of the plate, because of their narrow width, concentrate downward forces on such thickened region, tending to clamp the median regions of the first band member securely between the mattress supporting device and the lowermost surface of the mattress, when the mattress is resting on such mattress supporting surface. Thus, such opening provides a way of concentrating the force on the median regions of the belt.

A cord element, preferably fabricated from a rope similar to clothesline, or if desired, a line element similar to shock cord, extends between adjacent pairs of corner guards having the free ends of the cord member engaged in the notches located in the corner guards. The free ends of the cord element are knotted so that the length of the cord in use is adjusted to the width of the mattress to which the corner guards are applied. The cord element provides an inward force on the legs of the corner guards, thereby enhancing the frictional engagement with the supporting surface, tending to eliminate accidental dislodgement of the corner guard when the corner of the mattress adjacent any corner guard is lifted.

In use, the portion of the corner guard having the slots and notches, is installed parallel to the mattress supporting surface such that the "L" shaped cross-section of the corner guard extends normal to the corner of the supporting surface and the corner of the mattress supported thereby. The entire harness assembly including the plate member and the cord elements rests upon the mattress supporting surface, covered by the lowermost surface of the mattress. Thus, it can be seen, that the corner guard assembly, constituting the uppermost end thereof residing below the uppermost surface of the mattress, and the lowermost end thereof residing below the mattress supporting surface of the mattress supporting device, causes each corner guard to be securely clamped to the corners of the mattress and to the corners of the mattress supporting device, utilizing the flexible bands therefor. Further, such corner guards, when the mattress is lifted, is retained in clamping engagement with the mattress supporting device because the cord elements prevent the corner guard from flying inwardly when the mattress corner is lifted. Therefore, it can be seen, that a bed may be made up in an orderly fashion, without at any one time requiring the removal of the corner guards. Further, since the apparatus is not attached permanently or semi-permanently, such as by screws, rivets, bolts or the like, to the mattress supporting device or the mattress, mattresses can be frequently turned or replaced and other cleaning process may take place in an orderly fashion.

Now referring to the Figures, and more particularly to the embodiment illustrated in FIG. 1 showing a mattress supporting surface 10, such as a box spring, having a generally rectangular bar shape. Corner elements 12 are shown installed at each of the corners of mattress 10 having legs 14 and 16 disposed at right angles to each other. An additional plate 18 is attached to legs 14 and 16 and is provided with a pair of parallel spaced apart slots 20 and 22. Notches 24 extend in plate member 18 having a portion of their length 26 disposed parallel to legs 14 and 16 and a portion of their length 28 disposed transverse extending outwardly away from legs 14 and 16. Flexible cord elements 30 and 32 extend between adjacent pairs of corner elements by having the free ends thereof engage slots 24, and more particularly portions 28 thereof. A first band member 34 engages plate member 36 by passing through slots 38 and 40 disposed in skew relationship. Opening 42 facilitates securing band member 34 at an acute angle formed by portions 44 and 46 of the length thereof.

Opening 42 is bounded by legs 88 and 90, in part. Such legs, defining opening 42, have the free most ends thereof engage region 92, of belt 34, where portions 44 and 46 overlap one another. Thus, any downward force, applied to plate member 36, is concentrated when it is applied to region 92, tending to maintain flexible band member 34 in non-sliding relationship when passing through slots 38 and 40. Region 46, of flexible band 34, extends away from the corner guard 12, shown in the upper right hand corner of the apparatus depicted in FIG. 1. Region 46 then passes into slot 38, after first proceeding below the lowermost surface of plate 36. Region 94, of flexible band 34, is seen extending in overlying relationship over plate 36, extending between slot 38 and 40. Region 44, of flexible band 34, by passing through slot 40 resides also below portion 46, of flexible band 34, in region 92. Thus, one near median portion of band 34 underlies another near median portion, in region 92, having legs 88 and 90 disposed in touching engagement therewith, for clamping and anti-sliding purposes.

Ends 48 and 50, of band member 34, pass through slots 20 and 22 in plate 18 of the uppermost pair of adjacent corner guards 12. Band members 52 and 54 have a portion of their length provided with an elastic member 56 and 58. If desired, portions 44 and 46 of band member 34, may also be provided with an elastic member similar to elastic members 56 and 58. Plate member 36 may be fabricated from a metallic sheet or a plastic material such as polypropylene. The free ends 60 and 62 of band member 52 and the free ends 64 and 66 of band member 54, pass through slots 20 and 22 of the lowermost pair of adjacent corner guard members 12 and through slots 68 and 70, and slots 72 and 74 located in plate member 36. By pulling on the free ends of bands 52 and 54, inwardly towards elastic members 56 and 58 respectively, the length of band members 52 and 54 may be adjusted so as to accommodate various sized mattresses, not shown, and supporting surfaces 10.

Figure 2:
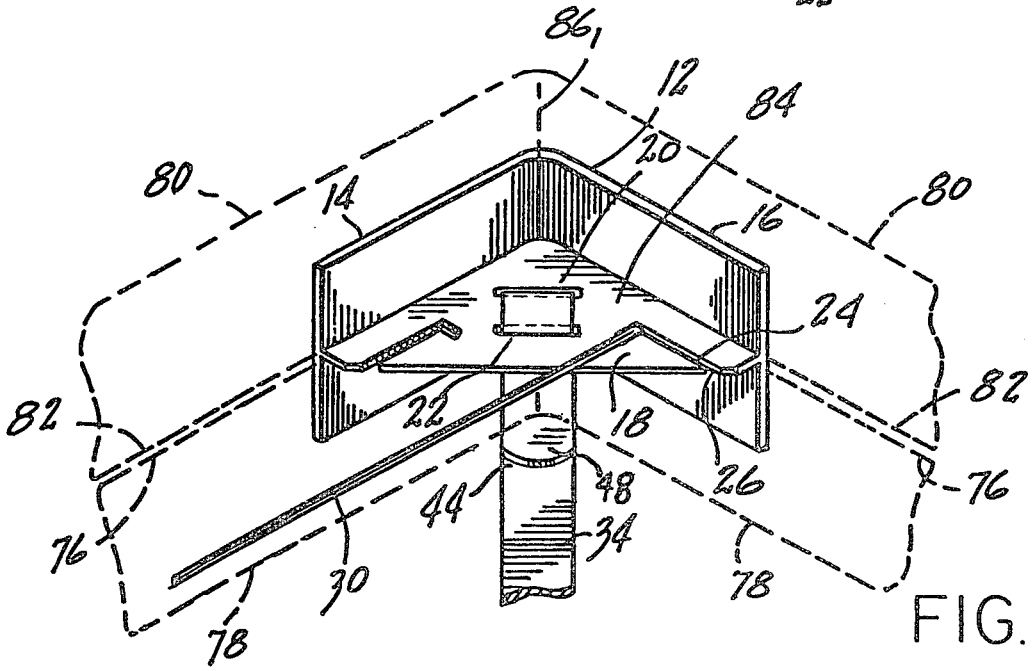
FIG. 2 is a perspective view of a portion of the present invention.

FIG. 2 illustrates dotted lines 76 and 78 delineating the marginal edges of the lowermost supporting structure. Supporting surface 10 as shown in FIG. 1, extends across dotted lines 76. Additional plate 18 is shown extending parallel to dotted line 76 and hence supporting surface 10, not shown. Dotted lines 80 and 82 define the marginal walls of a mattress whose lowermost lateral surface, not shown, rests upon the uppermost lateral surface 84 of plate 18. The mattress corner is defined by dotted lines 86 shown extending at the intersection of legs 14 and 16.

One advantage of the present invention is an inexpensive mattress securing device which facilitates convenient bed sheet replacement.

Another advantage of the present invention is an apparatus which may be conveniently installed to any sized mattress and equivalently sized supporting structure therebelow.

Still another advantage of the present invention is an apparatus which remains in place when a corner of the mattress is lifted.

Yet another advantage of the present invention is an apparatus which utilizes the same components regardless of the size of the mattress.

Thus, there is disclosed in the above description and in the drawings, an embodiment of the invention which fully and effectively accomplishes the objects thereof. However it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A mattress securing apparatus for securing a mattress resting on a mattress supporting device, said device having an uppermost mattress supporting surface thereon disposed adjacent to and above side walls of said device, said mattress having an uppermost lateral surface and a lowermost lateral surface and four corners extending between said uppermost and said lowermost surfaces of said mattress, said uppermost surface of said mattress being disposed over said lowermost surface of said mattress when said mattress is disposed resting on said supporting surface, said mattress securing apparatus comprising four corner guards, each of said corner guards including a first plate, said first plate having two legs, said first plate having a first end and a second end, said two legs forming a right angle, a second plate, said second plate secured to said first plate, a lateral surface of said second plate being disposed normal to said legs, a harness, said harness removably secured to each of said four corner guards at said second plate portion thereof, said harness including a first and a second and a third flexible strap, the ends of said first flexible strap adjustably removably secured to a first and a second of said four corner guards, one end of said second flexible strap adjustably removably secured to a third of said four corner guards, one end of said third flexible strap adjustably removably secured to a fourth of said four corner guards, a third plate, the other ends of said second flexible strap and said third flexible strap and a portion of the length of said first flexible strap removably connected to said third plate, bias means for urging said each of said four corner guards towards the center of said supporting surface when said each of said four corner guards are disposed at said corners of said mattress and when said second plate is disposed intermediate said supporting surface and said lowermost surface of said mattress when said mattress is in said position on said supporting surface and when said first end of said first plate resides below said uppermost surface of said mattress and said second end of said first plate resides adjacent said walls of said mattress supporting device and when said first end of said first plate is in clamping engagement only with said mattress and said second end of said first plate is in clamping engagement with said device, including a portion of the length of said second and said third flexible straps each having a spring intermediate the ends thereof, cord means for flexibly connecting any one pair of adjacent pairs of said corner guards together when said second plate is disposed in said use position.

2. The apparatus as claimed in claim 1 wherein said spring comprises a flexible elastic member.

3. The apparatus as claimed in claim 1 further comprising said second plate having a pair of slots therein, said pair of slots located in spaced apart parallel relationship.

4. The apparatus as claimed in claim 1 further comprising a notch located in said second plate.

5. The apparatus as claimed in claim 1 further comprising said third plate having two pairs of elongated slots therein, each of said pair of elongated slots located in spaced apart parallel relationship to each other, one of said pair of elongated slots skew to the other of said pair of elongated slots, said third plate having an opening therein, another pair of elongated slots in said third plate, each of said another pair of elongated slots being located skew to on another and adjacent said opening.

6. The apparatus as claimed in claim 1 wherein said each of said corner guards comprises a plastic material.

7. The apparatus as claimed in claim 1 wherein said first plate and said second plate comprise a unitary construction.

8. The apparatus as claimed in claim 4 wherein said cord means comprises a flexible cord, one end of said flexible cord being disposed in removable engagement with said notch.

* * * * *